US005871157A

United States Patent [19]

Fukutomi et al.

[11] Patent Number: 5,871,157

[45] Date of Patent: Feb. 16, 1999

[54] FUEL INJECTION VALVE

[75] Inventors: Norihisa Fukutomi; Mamoru Sumida, both of Tokyo; Tsuyoshi Munezane, Kobe, all of Japan

[73] Assignee: Mitsubishi Denki Kabushiki Kaisha, Tokyo, Japan

[21] Appl. No.: 869,918

[22] Filed: Jun. 5, 1997

[30] Foreign Application Priority Data

Jul. 29, 1996 [JP] Japan ..... 8-198852

[51] Int. Cl.[6] ..... B05B 1/34

[52] U.S. Cl. ..... 239/463; 239/491; 239/494; 239/533.12

[58] Field of Search ..... 239/463, 472, 239/491, 492, 493, 494, 533.1, 533.2, 533.12, 585.1, 585.4, 585.5

[56] References Cited

U.S. PATENT DOCUMENTS

| | | | |
|---|---|---|---|
| 4,651,931 | 3/1987 | Hans et al. | 239/533.9 |
| 4,971,254 | 11/1990 | Daly et al. | 239/585.1 |
| 5,098,016 | 3/1992 | Okamoto et al. | 239/5 |
| 5,409,169 | 4/1995 | Saikalis et al. | 239/404 |
| 5,570,841 | 11/1996 | Pace et al. | 239/585.1 |
| 5,667,145 | 9/1997 | Schmidt et al. | 239/533.12 |
| 5,740,967 | 4/1998 | Simmons et al. | 239/494 |

FOREIGN PATENT DOCUMENTS

A-2-215963 8/1990 Japan .

*Primary Examiner*—Andres Kashnikow
*Assistant Examiner*—Lisa Ann Douglas
*Attorney, Agent, or Firm*—Sughrue, Mion, Zinn, Macpeak & Seas, PLLC

[57] ABSTRACT

A fuel injection valve comprises a valve unit 3 which includes a hollow valve body 9, a valve seat 11 provided at an end of the valve body and having an injection nozzle 10, a valve 12 movable in the valve body to come into contact with and separate from the valve seat 11 so that the injection nozzle 10 is opened and closed, and a swirler 13 which is arranged around the valve 12 to support the same in a slidable manner and which provides a swirling force to fuel flowing through the injection nozzle 10, wherein the swirler 13 has outer circumferential surface portions 19*a* which are in contact with an inner circumference of the valve body 9 to regulate the position with respect to the valve body 9; flow passage portions formed between adjacent outer circumferential surface portions 19*a* to define fuel passages for passing fuel in the axial direction, and swirling grooves 25 formed in the end surface which faces the valve seat 11 in the axial direction so as to be at an eccentric position with respect to the center axis of the swirler 13, and wherein an annular groove 24 is formed in the swirler 13 at an inner circumference of the end surface of the swirler facing the valve seat 11, and the swirling grooves 25 have respectively one end connected to one of the flow passage portions and the other end extending tangentially to the annular groove.

11 Claims, 5 Drawing Sheets

FUEL INJECTION VALVE

BACKGROUND OF THE INVENTION

1. Field of the Invention

The present invention relates to a fuel injection valve, in particular, to a cylinder injection type fuel injection valve. In more particular, it relates to a fuel injection valve of such a type that a swirling energy is given to a fuel stream by means of a swirling means so that fuel is injected through a fuel injection nozzle.

2. Discussion of Background

Heretofore, several kinds of fuel injection valve which inject highly pressurized fuel with high efficiency have been proposed. In particular, a cylinder injection type fuel injection valve of such a type that a swirling energy is given to a fuel stream to inject fuel through a fuel injection nozzle directly into a combustion chamber of an internal combustion engine, has been proposed. Such fuel injection valve is generally provided with an injection valve body comprising a valve (such as a needle valve, a spherical valve or the like) and a valve seat, a housing including a solenoid for operating the valve and a swirler which gives a swirling energy to a fuel stream.

However, publications concerning the proposed fuel injection valves have failed to describe in detail the shapes of the swirler, the valve seat and the fuel injection nozzle. Namely, the publications do not clearly show numerical values and relations of the shapes of the swirler which provides a desired pattern of fuel spray, the valve seat and the fuel injection nozzle. In particular, the publications do not clearly show structures of an injection valve which form a shape of fuel spray or the optimum combustion of fuel in a cylinder type injection engine.

SUMMARY OF THE INVENTION

It is an object of the present invention to provide a fuel injection valve for injecting fuel through a fuel injection nozzle by giving a swirling energy to a fuel stream thereby realizing the optimum shape of fuel spray by specifying the shapes of a swirler, a valve seat and a fuel injection nozzle.

According to the first aspect of the invention, there is provided a fuel injection valve comprising a valve unit which includes a hollow valve body, a valve seat provided at an end of the valve body and having an injection nozzle, a valve movable in the valve body to come into contact with and separate from the valve seat so that the injection nozzle is opened and closed, and a swirler which is arranged around the valve to support the same in a slidable manner and which provides a swirling force to fuel flowing through the injection nozzle, wherein the swirler has outer circumferential surface portions which are in contact with an inner circumference of the valve body to regulate the position with respect to the valve body; flow passage portions formed between adjacent outer circumferential surface portions to define fuel passages for flowing fuel in the axial direction, and swirling grooves formed in the end surface which faces the valve seat in the axial direction so as to be at an eccentric position with respect to the center axis of the swirler, the fuel injection valve being characterized in that an annular groove is formed in the swirler at an inner circumference of the end surface of the swirler facing the valve seat, and the swirling grooves have respectively one end connected to one of the flow passage portions and the other end extending in a tangential direction to the annular groove to be connected.

According to the second aspect of the invention, there is provided a fuel injection valve according to the first aspect wherein the depth of the annular groove is the same as the depth of the swirling grooves, and the number of the outer circumferential surface portions, the flow passage portions and the swirling grooves is in a range of 4 to 8.

According to the third aspect of the present invention, there is provided a fuel injection valve according to the second aspect wherein the number of the outer circumferential surface portions, the flow passage portions and the swirling grooves is 6.

According to the fourth aspect of the invention, there is provided a fuel injection valve according to the first aspect wherein each of the swirling grooves is eccentric by a predetermined distance to the center axis of a valve shaft so that a side surface of the swirling grooves, which is remoter from the center axis of the valve shaft, is extended in a tangential direction of the outer circumference of the annular groove to be contiguous to the outer circumference.

According to the fifth aspect of the invention, there is provided a fuel injection valve according to the fourth aspect wherein the opposing side surfaces of each of the swirling grooves are parallel to each other.

According to the sixth aspect of the invention, there is provided a fuel injection valve according to the first aspect wherein each of the flow passage portions form a side of a regular polygonal shape in a plane view of the swirler.

According to the seventh aspect of the present invention, there is provided a fuel injection valve according to the first aspect wherein the shapes of the annular groove, the valve and the valve seat are so determined that the sum of a volume of the annular groove and a volume of an area at a downstream side of the annular groove to reach a seating portion where the valve is brought to contact with the valve seat, provides a predetermined amount of fuel in the central spray.

According to the eighth aspect of the invention, there is provided a fuel injection valve according to the seventh aspect wherein the volume of the annular groove is larger than the volume of the area at a downstream side of the annular groove to reach a seat portion where the valve is brought to contact with the valve seat.

According to the ninth aspect of the invention, there is provided a fuel injection valve according to the first aspect wherein a side surface of the swirling grooves, which is remoter from the center axis of a valve shaft is extended in a tangential direction of the outer circumference of the annular groove, and the total length of arc portions of the annular groove is one fifth (1/5) or less as long as the length of the outer circumference of the annular groove in case that the annular groove takes the original circular form.

According to the tenth aspect of the invention, there is provided a fuel injection valve according to the first aspect wherein a proportion (L/D) of the length (L) of the injection nozzle 10 to the diameter (D) of the nozzle is 1.0–2.0.

According to the eleventh aspect of the invention, where is provided a fuel injection valve according to the first aspect wherein the surface area of the injection nozzle is larger than the maximum surface area of opening of a seat portion where the valve is brought to contact with the valve seat.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
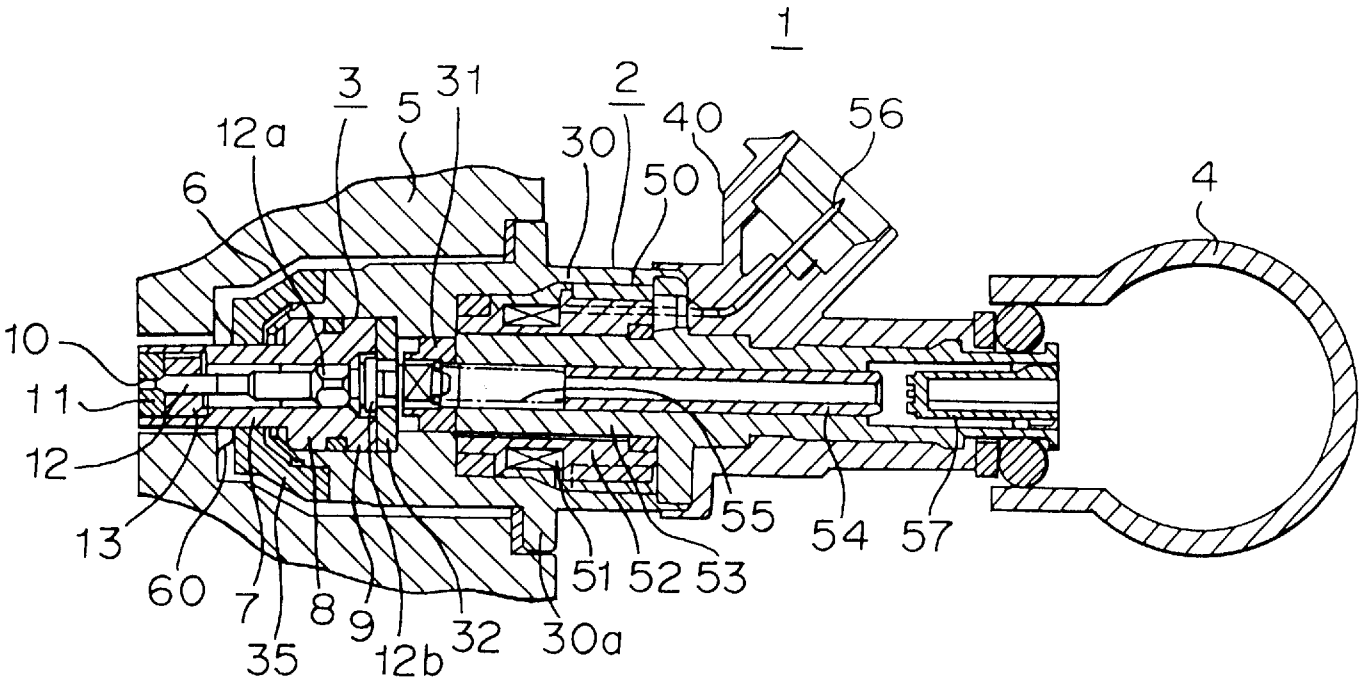
FIG. 1 is a longitudinal cross-sectional view showing the entire structure of an embodiment of the cylinder injection type fuel injection valve according to the present invention.

Detailed description of the present invention will be described with reference to the drawings wherein the same reference numerals designate the same or corresponding parts.

FIG. 1 is a longitudinal cross-sectional view showing the basic construction of a cylinder injection type fuel injection valve according to an embodiment of the present invention.

A cylinder injection type fuel injection valve 1 comprises a housing 2 and a valve unit 3 which is connected to an end of the housing by caulking or the like and is covered with a holder 35. The other end of the housing is connected with a fuel supply tube 4 through which higher pressurized fuel is fed in the cylinder injection type fuel injection valve 1 via a fuel filter 57. A tip portion of the cylinder injection type fuel injection valve 1 is inserted in an injection valve inserting port 6 of a cylinder head 5 in an internal combustion engine and is sealingly attached to the cylinder head 5 by means of a wave washer 60 or the like.

The valve unit 3 comprises a valve body 9 of a hollow cylindrical shape with a stepped portion including a cylindrical portion of a small diameter 7 and a cylindrical portion of large diameter 8, a valve seat 11 provided with a fuel injection nozzle 10, which is firmly connected to a tip portion of the central opening of the valve body 9, a needle valve 12 as a valve which is brought to contact with and separated from the valve seat 11 by means of a solenoid 50, which is described later, to open and close the fuel injection nozzle 10, and a swirler 13 which guides the needle valve 12 in the axial direction and which gives a swirling movement to fuel which is fed inwardly in the radial direction to the fuel injection nozzle 10 of the valve seat 11. The valve body 15 of the valve unit 3 constitute a housing for the cylinder injection type fuel injection valve 1 in association with the housing 2.

The housing 2 comprises a first housing portion 30 having a flange 30*a* for fixing the cylinder injection type fuel injection valve 1 to the cylinder head 5 and a second housing portion 40 connected with the solenoid 50. The solenoid 50 has a bobbin portion 52 around which a coil 51 is wound and a core 53 disposed in an inner circumferential portion of the bobbin portion 52 wherein the winding wire of the coil 51 is connected to a terminal 56. The core 53 is of a hollow cylindrical shape which provides a fuel passage, and the hollow portion includes a spring 55 which is disposed between a sleeve 54 and the needle valve 12.

A movable armature 31 is attached to the other end of the needle valve 10 so as to oppose an end portion of the core 53. At an intermediate portion of the needle valve 12, there are provided a guide 12*a* which guides the valve 12 in a slidable manner along the inner circumference of the valve body 9 and a needle flange 12*b* which is in contact with a spacer 32 disposed in the first housing portion 30.

Figure 2:
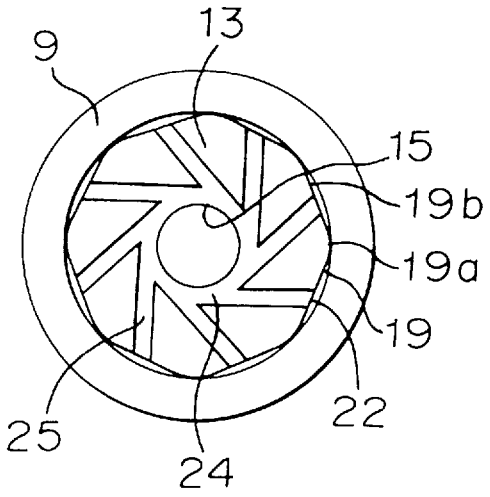
FIG. 2 is a front view of an embodiment of a swirler used in the present invention wherein the swirler is observed from a valve seat side.
Figure 3:
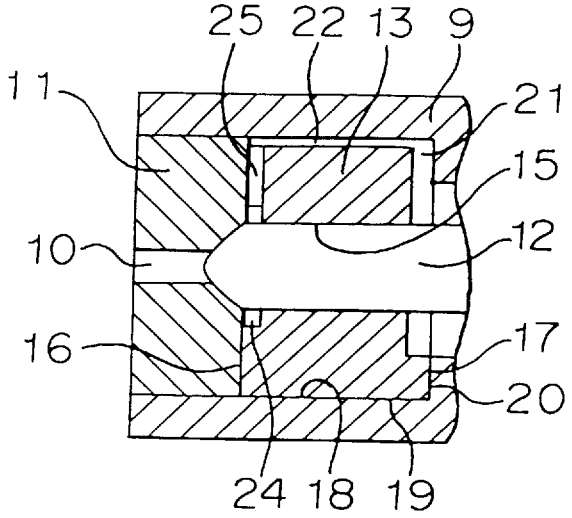
FIG. 3 is an enlarged cross-sectional view showing a portion around a valve seat in a valve unit according to an embodiment of the present invention.

FIG. 2 is a front view of the swirler 13, which is observed from the side of the valve seat 11, and FIG. 3 is an enlarged cross-sectional view showing the valve seat of the valve unit 3 and a portion around the valve seat. The swirler 13 of the valve unit 3 is a substantially hollow cylindrical member having a central opening 15 which surrounds the needle valve 12 and supports the same so as to be slidable in the axial direction. When the swirler 13 is assembled in the valve unit 3, it provides a first end surface 16 which is in contact with the valve seat 11, a second end surface 17 which is opposite the valve seat 11 and an outer circumference 19 extending between these end surfaces and having portions contacting to an inner circumference 18 of the valve body 9 which is a part of a hollow housing.

The second end surface 17 of the swirler 13 has a peripheral portion which is in contact with and supported by a shoulder portion 20 of the inner circumference 18 of the valve body 9, and the second end surface 17 includes at least one diametrically extending groove 21 so that fuel can flow from an inner circumferential portion to an outer circumferential portion of the second end surface 17.

The outer circumference 19 of the swirler 13 includes a number of flat surfaces which are apart from each other in a circumferential direction with equal distances and extend in an axial direction. As a result, the outer circumference 19 includes a plurality of outer circumferential surface portions 19*a* which are in contact with the inner circumference 18 of the valve body 9 to regulate the position of the swirler 13 with respect to the valve body 9, and the flat surfaces as flow passage portions 19*b* defined between adjacent outer circumferential surface portions 19*b*, the flow passage portions 19*b* being in association with the inner circumference 18 of the valve body 9 to form fuel passages 22 for flowing fuel in the axial direction.

In the end surface in the axial direction of the swirler 13 facing the valve seat 11, i.e., the first end surface 16, there are formed an inner annular groove 24 having a predetermined width which is formed at an inner periphery adjacent to the center opening 15 in the first end surface 16, and swirling grooves 25 each having an end connected to one of the flow passage portions 19*b* of the outer circumference 19 and the other end extending inwardly in a substantially radial direction and connected to the inner annular groove 25 in a tangential direction.

Operations of the above-mentioned cylinder injection type fuel injection valve will be described.

In FIG. 1, when an electric current is supplied from the outside through the terminal 56 to the coil 51 of the solenoid 50, a magnetic flux is produced in a magnetic circuit constituted by the movable armature 31, the core 53 and the housing 2 whereby the movable armature 31 is attracted to the core 53 against an elastic force of the spring 55. Then, the needle valve 12 firmly connected to the movable armature 31 is moved in the right side of the drawing with a predetermined stroke until the needle flange 12*b* of the needle valve 12 comes in contact with the spacer 32. The needle valve 12 is guided and supported by the inner circumference of the valve body 9 by means of the guide 12*a*.

In FIGS. 2 and 3, when the front end portion of the needle valve 12 is separated from the valve seat 11 so that a space is formed, highly pressurized fuel introduced through the fuel supply tube 4 is passed from a space between the valve body 9 and the needle valve 12 through the groove 21 in the second end surface 17 of the swirler 13 to the axially extending fuel flow passages 22 formed between the outer circumferential surface portions 19*a* and the inner circumference of the valve body 9. Then, the fuel is introduced inwardly in the radial direction of the swirling grooves 25 in the first end surface 16 of the swirler 13. Then, the fuel is passed into the inner annular groove 24 in the first end surface 16 in a tangential direction to form a swirling stream. The swirling stream enters in the injection nozzle 10 of the valve seat 11 so as to be sprayed through the outlet at the front end of the nozzle.

A modified embodiment of basic construction of the above-mentioned embodiment will be described.

Figure 4:
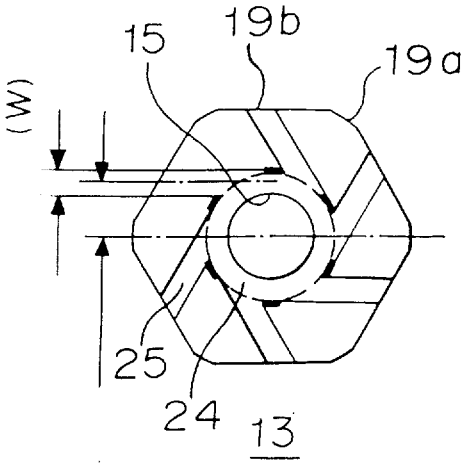
FIGS. 4*a*–4*c* are diagrams which explain in detail an embodiment of a swirler, a valve unit and a valve seat used for the present invention.
Figure 4:
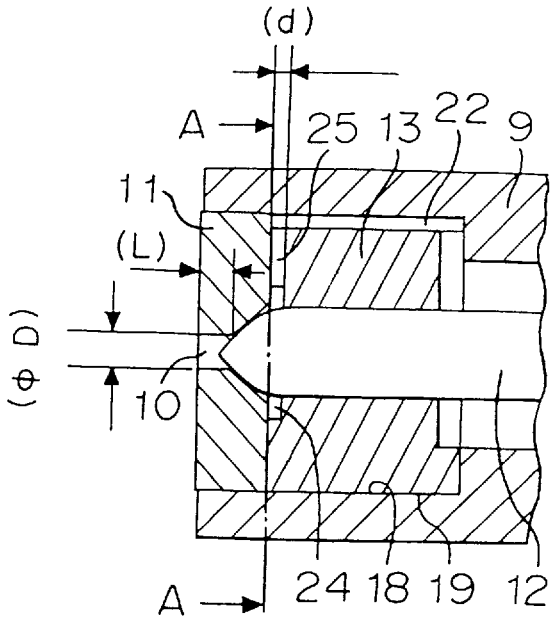
Figure 4:
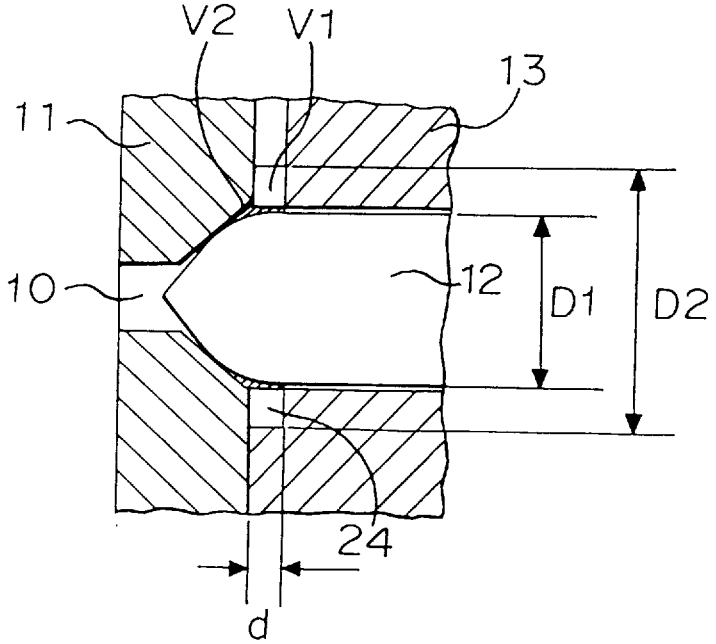

In the above-mentioned cylinder injection type fuel injection valve 1, when the number of swirling grooves 25 of the swirler 13 is too small, it is difficult to uniformly mix swirling streams from the swirling grooves 25 and to form a sufficient strength in the swirling streams. On the other hand, when the number is too large, there causes disturbance in the swirling streams, and a pressure loss may influence the flowing characteristics. Accordingly, a 4–8 number of swirling grooves is appropriate. In particularly, provision of 6 swirling grooves is preferable as shown in FIG. 4. When the number is smaller than 4, there is possibility that uniformly mixing of the swirling streams is insufficient. On the other hand, when the number is larger than 8, there is a possible pressure loss in each of the grooves, and the pressure loss in a passage at the upstream side influences the flowing characteristics.

As shown in FIG. 4*a*, each of the swirling grooves 25 is at an offset (eccentric) position by a predetermined distance to the center axis of a valve shaft so that a side surface of each of the swirling grooves 25, which is remoter from the valve shaft is contiguous to the outer circumference of the inner annular groove 24 in a tangential direction. Further, opposing side surfaces of each of the swirling grooves 25 are parallel to each other whereby fuel flowing from the swirling grooves is introduced smoothly at a high speed into the inner annular groove 24 in the tangential direction. In this case, there is no problem that a plurality of fuel streams from the swirling grooves 25 impinge on each other, or that a newly added fuel stream impinges on an already formed fuel stream, whereby the fuel flows smoothly and a large pressure loss due to impingement or disturbance does not take place.

In a further modified embodiment, the depth (d) of the swirling grooves 25 is formed to be equal to the depth (d) of the inner annular groove 24. When the depth of the swirling grooves 25 is larger than the depth of the inner annular groove 24, a step portion is formed at the connecting portion, and there is disturbance in a fuel stream, and fuel is not smoothly introduced in the inner annular groove 24. On the other hand, when the depth of the swirling grooves 25 is smaller than the depth of the annular groove 24, a vortex takes place in a fuel stream in the annular groove 24 whereby formation of a smooth swirling stream is prevented.

Further, as shown in FIG. 4*a*, the outer circumference of the swirler 13 preferably has flat surface portions which constitute six sides of a substantially polygonal shape. Specifically, the outer circumference of the swirler 13 comprises six flow passage portions 19*b* to form axially extending flow passages 22 of fuel in association with the inner circumference 18 of the valve body 9 and six outer circumferential surface portions 19*a* each having a shape formed by cutting each of six corners of a regular hexagonal shape into an arc form wherein the outer circumferential surface portions 19*a* are in contact with the inner circumference 18 of the valve body 9 to regulate the position of the swirler 13 with respect to the valve body 9.

Further, the swirling grooves 25 are formed with substantially equal distances wherein the swirling grooves 25 have respectively an end communicating with the middle portion of an flow passage portion 19*b* which corresponds to one of the six sides of a regular hexagonal shape and the other end connected to the inner annular groove 24 formed at an inner circumference of the central opening 15 in a tangential direction.

As described above, since the swirler 13 has the outer circumference of a substantially hexagonal shape wherein the swirling grooves 25 are formed with substantially equal distances in the hexagonal swirler 13 and have respectively an end communicated with the middle portion of a flow passage portion 19*b* corresponding to a side of the six sides and the other end connected to the inner annular groove 24 in a tangential direction, fuel streams are smoothly introduced at a substantially uniform flow rate and a uniform flow speed through six swirling grooves 25, and can form smooth and uniformly mixed swirling streams in a swirling chamber formed by the inner annular groove 24.

In the above-mentioned modified embodiment, description has been made as to the construction wherein the outer circumference of the swirler 13 is formed into a substantially hexagonal shape and each of the flow passage portions 19*b* in the outer circumference of the swirler 13 is made in correspondence to a side of six sides of the regular hexagonal shape. However, the flow passage portions 19*b* may be slightly bulged out in an outer circumferential direction, or is slightly recessed in an inner circumferential direction.

Another embodiment of the fuel injection valve of the present invention will be described.

Figure 5:
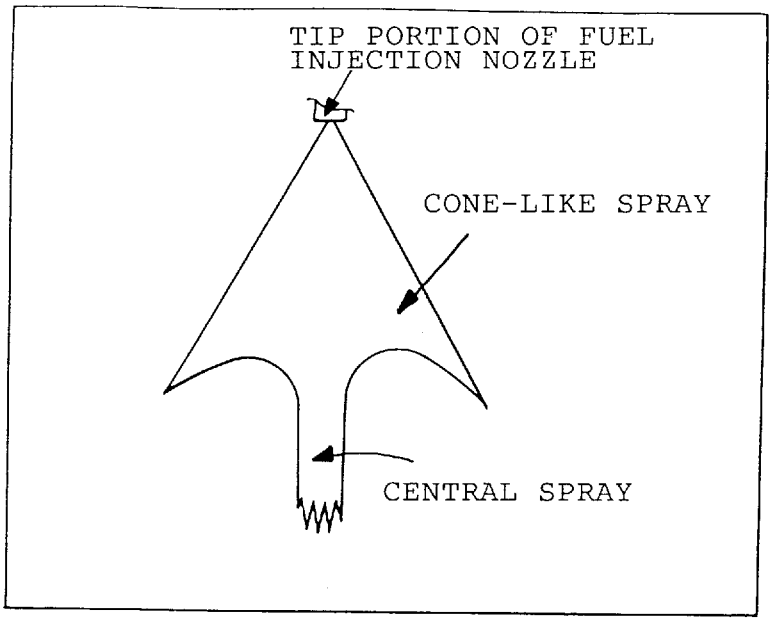
FIG. 5*a* is a vertical sectional view of a shape of fuel injection according to an embodiment of the present invention.
FIG. 5*b* is a graph showing a relation of a flow rate to an angle with respect to the center of the fuel injection valve.
Figure 5:
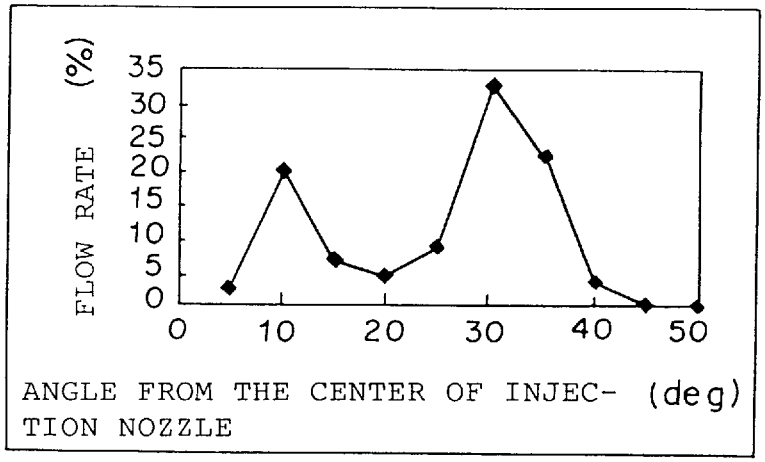

FIG. 5*a* is a diagram showing a vertical sectional view of highly pressurized fuel injected into an engine cylinder by opening the valve body 12, and FIG. 5*b* is a graph showing a relation of a flow rate of fuel to an angle with respect to the center line of the fuel injection valve.

As shown in FIG. 5*a* which indicates the vertical sectional view of injected fuel (under the atmospheric pressure), the shape of the injected fuel consists of a central spray wherein fuel is injected substantially straightforwardly or linearly from the fuel injection nozzle 10 and a cone-like spray wherein fuel is injected at a predetermined angle with respect to the axial line of the fuel injection nozzle 10.

In the central spray of fuel, fuel which stays in and around the inner annular groove 24 of the swirler 13 is injected through the fuel injection nozzle 10 by a pushing force of highly pressurized fuel at an upstream side as soon as the needle valve 12 is separated from the valve seat 11 (i.e., the valve is opened). Since any swirling energy is not given to a fuel stream due to the fuel staying in and around the inner annular groove 24, the fuel stream is injected substantially straightforwardly or linearly. Just after the fuel staying in and around the inner annular groove 24 has been injected, fuel at an upstream side is introduced into the inner annular groove 24 via the swirling grooves 25 during which a swirling energy is given to fuel streams, whereby fuel is injected in a cone-like shape with a predetermined angle from the fuel injection nozzle 10.

The fuel in the central spray contributes combustion due to ignition at an ignition plug. However, an amount of fuel in the central spray should be minimum for requirement. When an amount of fuel in the central spray is too much, an ignition residue takes place whereby a toxic material is discharged as exhaust gas to the atmosphere.

In this embodiment, an amount of fuel in the central spray can be controlled to a specified value. As shown in FIG. 4*c*, an amount of fuel in the central spray is the sum of a volume V1 in the inner annular groove 24 (a volume of swirling chamber) and a volume V2 of an area at a downstream side of the inner annular groove 24 to reach a seating portion where the needle valve 12 is brought to contact with the valve seat 11 (the volume V2 being indicated by a finely hatching portion). Namely, an amount of fuel in the central spray V is expressed by $$V=V1+V2. \quad (1)$$

Further, when the volume of the inner annular groove V1 can be expressed by:

$$V1=\pi\{D2^2-D1^2\}/4\times d \quad (2)$$

where D1 represents the diameter of the needle valve 12, D2 represents the outer diameter of the inner annular groove, and d represents the depth of the inner annular groove.

The volume V1 is made larger than the volume V2. Further, shapes and dimensions of the inner annular groove 24, the needle valve 12 and the valve seat 11 are so determined that the sum of the volumes V1 and V2 provides a predetermined amount of fuel in the central spray.

Thus, by determining the shapes and the dimensions of the inner annular groove 24, the needle valve 12 and the valve seat 11 so that the optimum amount of fuel in the central spray is previously set, a needles amount of fuel is prevented from injection, and a toxic material is prevented from discharging.

An amount of fuel in the central spray should be minimum as possible. In order to perform such requirement, it is necessary to form the volume of the inner annular groove 24 to be small. Since there is limitation to reduce the diameter of the inner annular groove 24, the depth d of the groove 24 should be reduced. For this, the depth of the swirling grooves 25 should be reduced. However, in order to keep a sufficient amount of swirling streams, it is necessary to increase the width W of the swirling grooves 25.

For the purpose of forming the width W of the swirling grooves 25 as large as possible, the width W is specified in connection to the length of the outer circumference of the inner annular groove 24. Namely, the swirling grooves 25, which are offset (eccentric) with respect to the valve shaft of the needle valve in a plane perpendicular to the valve shaft, are so formed that a side surface of the annular grooves, which is remoter from the center axis of the valve shaft is extended to be contiguous in a tangential direction to the outer circumference of the inner annular groove 24, and the total length of outer circumferential portions (arc portions) of the inner annular groove 24, which remain geometrically (the outer circumferential portions being indicated by thick lines in FIG. 4*a*) is one fifth (⅕) or less as long as the length of the outer circumference of the inner annular groove 24 in case that the inner annular groove 24 takes the original circular form (the outer circumference being indicated by the thick line portions+dotted line portions in FIG. 4*a*).

Another embodiment of the fuel injection valve of the present invention is described. In this embodiment, the shape of the fuel injection nozzle 10 is specified in order to obtain a stable swirling force to fuel to be injected and to prevent carbon deposit.

As shown in FIG. 4*b*, the ratio (L/D) of the length (L) of the fuel injection nozzle 10 and the diameter (D) of the same is determined to be 1.0–2.0.

When L/D is too small, a swirling force in the fuel injection nozzle 10 loses stability whereby scattering in a pattern of sprayed fuel becomes large.

Although scattering in a pattern of sprayed fuel becomes small when L/D is larger, a surface area on which carbon resulted from combustion deposits is increased. Further, the thermal capacity of the valve seat 11 is also increased to keep heat whereby an amount of carbon deposit is increased.

Another embodiment of the fuel injection valve of the present invention is described.

Figure 6:
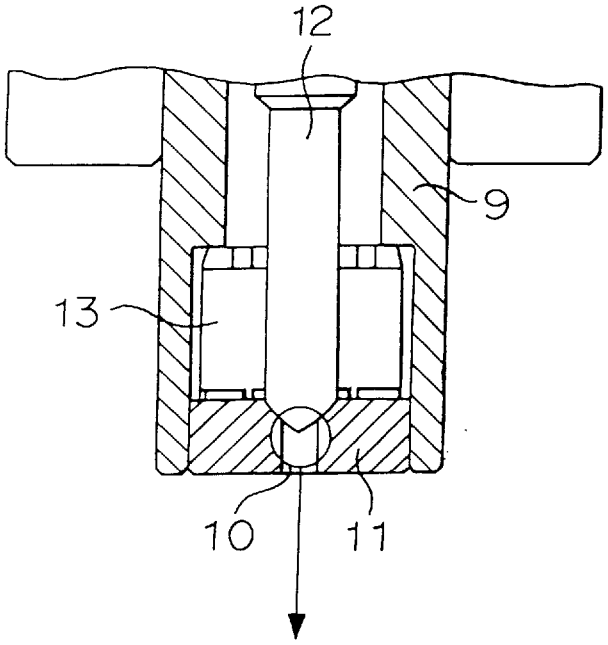
FIG. 6*a* and 6*b* are enlarged cross-sectional views showing the fuel injection nozzle and related portions according to an embodiment of the present invention.
Figure 6:
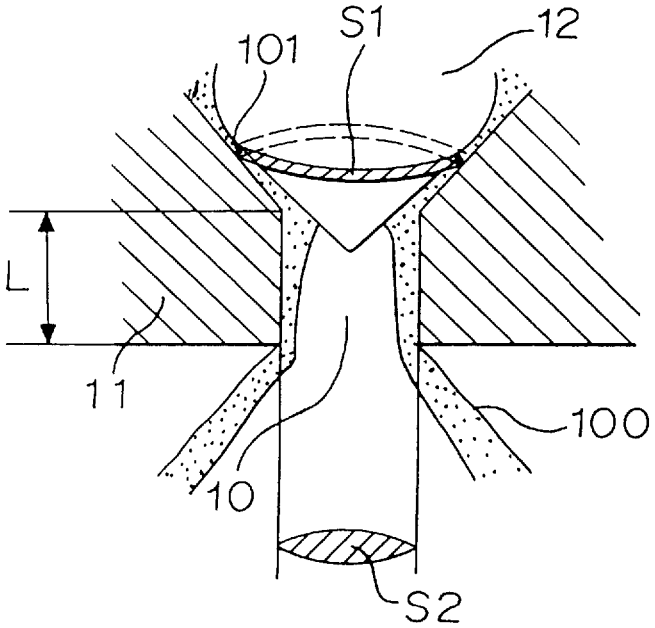

As shown in FIG. 6*b*, a swirling force is given to fuel by means of the swirler 13 and fuel is injected as swirling streams through the fuel injection nozzle 10. A fuel stream 100 forms a spray pattern having a cavity in the fuel injection nozzle 10. An effective area of injection nozzle through which the fuel stream passes is smaller than the actual surface area of injection nozzle 10. Accordingly, in order to maintain a fuel injection pattern having a cavity and to obtain a stable swirling streams of fuel in this embodiment, a surface area S2 of the injection nozzle 10 is formed to be larger than a surface area S1 of flow passage at a seat portion 101 at the time when the needle valve 12 is lifted at the maximum distance from the valve seat 11.

According to an aspect of the present invention wherein an inner annular groove is formed in a swirler at an inner circumference of the end surface of the swirler facing a valve seat, and swirling grooves have respectively one end connected to one of the flow passage portions and the other end extending in a tangential direction to the inner annular groove to be connected, there is obtainable a preferred pattern of fuel spray consisting of a central spray portion and a cone-like spray portion with a predetermined angle with respect to a fuel injection nozzle.

According to another aspect of the present invention wherein in addition to the features of the above-mentioned, the number of the swirling grooves is 4 to 8, swirling streams from the swirling grooves can uniformly be mixed. Further, there is no danger of disturbance of swirling stream and a pressure loss. Further, when the depth of the annular groove is made substantially equal to the depth of the swirling grooves, fuel to be injected can smoothly be introduced from the swirling grooves to the annular groove.

According to another aspect of the present invention wherein the number of the outer circumferential surface portions, the flow passage portions and the swirling grooves of the swirler is six, the swirling streams can further be uniformly mixed and a sufficient strength of swirling streams can be formed without resulting disturbance in swirling streams and loss in pressure.

According to another aspect of the present invention wherein each of the swirling grooves is eccentric by a predetermined distance to the center axis of a valve shaft so that a side surface of the swirling grooves, which is remoter from the center axis of the valve shaft, is extended in a tangential direction of the outer circumference of the annular groove to be contiguous to the outer circumference, and in this case, in particular, the opposing side surfaces of each of the swirling grooves are parallel to each other, fuel can smoothly be introduced at a high speed from the swirling grooves to the annular grooves in a tangential direction whereby there is no danger of impingement of fuel streams.

In another aspect of the present invention wherein each of flow passage portions which forms a flow passage in the axial direction which is formed between adjacent outer circumferential surface portions in contact with the inner circumference of the valve body, constitutes each side of a regular polygonal shape, and the swirling grooves are provided with substantially equal distances so that they are extended from the flow passage portions to the annular grooves in a tangential direction, fuel streams can be introduced through the swirling grooves to the annular groove at a substantially uniform flow rate and a uniform flow speed whereby a uniformly mixed swirling stream can be formed.

In another aspect of the present invention wherein the shapes of the annular groove, the valve and the valve seat are so determined that the sum of a volume of the annular groove and a volume of an area at a downstream side of the annular groove to reach a seating portion where the valve is brought to contact with the valve seat, a desired amount of fuel in the central spray can be provided.

In another aspect of the present invention wherein the volume of the annular groove is larger than the volume of the area at a downstream sided of the annular groove to reach a seat portion where the valve is brought to contact with the valve seat, the shapes of the annular groove, the valve and the valve seat can easily be determined, and an amount of fuel in the central spray can be controlled.

In another aspect of the present invention wherein a side surface of the swirling grooves, which is remoter from the center axis of a valve shaft is extended in a tangential direction of the outer circumference of the annular groove, and the total length of arc portions of the annular groove is 1–5 or less as long as the length of the outer circumference of the annular groove in case that the annular groove takes the original circular form.

In another aspect of the present invention wherein the ratio (L/D) of the length (L) to the diameter (D) of the injection nozzle is to be 1.0–2.0, a stable swirling force is given to fuel to be injected and carbon deposit can be prevented.

In another aspect of the present invention wherein the surface area of the injection nozzle is larger than the maximum surface area of opening of a seat portion where the valve is brought to contact with the valve seat, an injection pattern of fuel having a cavity is formed in the injection nozzle, and a uniform and stable swirling stream can be injected through the injection nozzle.

Obviously, numerous modifications and variations of the present invention are possible in light of the above teachings. It is therefore to be understood that within the scope of the appended claims, the invention may be practiced otherwise than as specifically described herein.

What is claimed is:

1. A fuel injection valve which comprises a valve unit 3 which includes a hollow valve body 9, a valve seat provided at an end of the valve body and having an injection nozzle, a valve movable in the valve body to come into contact with and separate from the valve seat so that the injection nozzle is opened and closed, and a swirler which is arranged around the valve to support the same in a slidable manner and which provides a swirling force to fuel flowing through the injection nozzle, wherein the swirler has outer circumferential surface portions which are in contact with an inner circumference of the valve body to regulate the position with respect to the valve body; flow passage portions formed between adjacent outer circumferential surface portions to define fuel passages for passing fuel in the axial direction; and swirling grooves formed in the end surface which faces the valve seat in the axial direction so as to be at an eccentric position with respect to the center axis of the swirler, the fuel injection valve being characterized in that an annular groove is formed in the swirler at an inner circumference of the end surface of the swirler facing the valve seat, and the swirling grooves have respectively one end connected to one of the flow passage portions and the other end extending in a tangential direction to the annular groove to be connected.

2. A fuel injection valve according to claim 1, wherein the depth of the annular groove is the same as the depth of the swirling grooves, and the number of the outer circumferential surface portions, the flow passage portions and the swirling grooves is in a range of 4 to 8.

3. A fuel injection valve according to claim 2, wherein the number of the outer circumferential surface portions, the flow passage portions and the swirling grooves is 6.

4. A fuel injection valve according to claim 1, wherein each of the swirling grooves is eccentric by a predetermined distance to the center axis of a valve shaft so that a side surface of the swirling grooves, which is remoter from the center axis of the valve shaft, is extended in a tangential direction of the outer circumference of the annular groove to be contiguous to the outer circumference.

5. A fuel injection valve according to claim 4, wherein the opposing side surfaces of each of the swirling grooves are parallel to each other.

6. A fuel injection valve according to claim 1, wherein each of the flow passage portions form a side of a regular polygonal shape in a plane view of the swirler.

7. A fuel injection valve according to claim 1, wherein the shapes of the annular groove, the valve and the valve seat are so determined that the sum of a volume of the annular groove and a volume of an area at a downstream side of the annular groove to reach a seating portion where the valve 12 is brought to contact with the valve seat 11, provides a predetermined amount of fuel in the central spray.

8. A fuel injection valve according to claim 7, wherein the volume of the annular groove is larger than the volume of the area at a downstream side of the annular groove to reach a seat portion where the valve is brought to contact with the valve seat.

9. A fuel injection valve according to claim 1, wherein a side surface of the swirling grooves, which is remoter from the center axis of a valve shaft is extended in a tangential direction of the outer circumference of the annular groove, and the total length of arc portions of the annular groove is one fifth (1/5) or less as large as the length of the outer circumference of the annular groove in case that the annular groove takes the original circular form.

10. A fuel injection valve according to claim 1, wherein a proportion (L/D) of the length (L) of the injection nozzle 10 to the diameter (D) of the nozzle is 1.0–2.0.

11. A fuel injection valve according to claim 1, wherein the surface area of the injection nozzle is larger than the maximum surface area of opening of a seat portion where the valve is brought to contact with the valve seat.

* * * * *